United States Patent [19]

Okamoto

[11] Patent Number: 4,855,785

[45] Date of Patent: Aug. 8, 1989

[54] TRIMMING COPYING MACHINE

[75] Inventor: Yuji Okamoto, Nara, Japan

[73] Assignee: Sharp Kabushiki Kaisha, Osaka, Japan

[21] Appl. No.: 222,354

[22] Filed: Jul. 20, 1988

Related U.S. Application Data

[63] Continuation of Ser. No. 21,801, Mar. 4, 1987, abandoned.

[30] Foreign Application Priority Data

Mar. 5, 1986 [JP] Japan ..... 61-47949

[51] Int. Cl.[4] ..... G03G 15/00

[52] U.S. Cl. ..... 355/218; 355/233; 355/311

[58] Field of Search ..... 355/7, 3 R, 3 SH, 14 SH, 355/55, 8

[56] References Cited

U.S. PATENT DOCUMENTS 4,417,805 11/1983 Kishi ..... 355/7 X 4,501,490 2/1985 Miyamoto et al. ..... 355/55

4,634,266 1/1987 Migita et al. ..... 355/55

4,657,380 4/1987 Hamano et al. ..... 355/55

4,674,864 6/1987 Stakenborg et al. ..... 355/55 X 4,682,877 7/1987 Fujiwara et al. ..... 355/55 X 4,707,126 11/1987 Ohshima et al. ..... 355/7 X

*Primary Examiner*—A. C. Prescott

*Attorney, Agent, or Firm*—Flehr, Hohbach, Test, Albritton & Herbert

[57] ABSTRACT

In a trimming copying machine, a document is scanned in one direction and a copy paper is fed corresponding to this scanning motion such that an image of only a specified area of the document is obtained. The user sets the distance between the starting point of the scan and the backward edge of the specified area away from the starting position of the scan and the machine's control system determines whether the image will protrude from the copy paper position. The feeding of the copy paper is appropriately delayed such that the enlarged image will not stick out of the paper position.

3 Claims, 3 Drawing Sheets

TRIMMING COPYING MACHINE

BACKGROUND OF THE INVENTION

This invention relates to a trimming copying machine and more particularly to a copying machine capable of preventing an enlarged image from sticking out of the copy paper position when only a specified area of an original document is copied.

There have been known trimming copying machines capable of copying only a specified portion of an original document and also those capable not only of trimming but also of enlargement and reduction. With a conventional trimming copying machine, however, the enlarged image of a specified area frequently sticks out of the copy paper position and this occurs especially when the specified area is near the backward edge of the scanned range. This is illustrated in FIG. 5 wherein G indicates an original document to be scanned in the direction indicated by the arrow $\alpha$, $g_1$ and $g_2$ respectively indicate the starting position and the end position of the scan and L indicates the width of the document G in the direction of the scan. Let us assume that a rectangular area A is to be copied with magnification M. The sides of the specified area A proximal to the starting position $g_1$ and to the end position $g_2$ of the scan (the left-hand and right-hand sides in FIG. 5) are indicated respectively by $a_1$ and $a_2$ and are hereinafter also referred to as the forward edge and the backward edge, respectively. The distance between the starting position $g_1$ of the scan and the forward edge $a_1$ of the specified area A is indicated by l and that between the starting position $g_1$ and the backward edge $a_2$ of the area A is indicated by l'.

With a conventional trimming copying machine, not only the specified area A but also the distances l and l' of its boundaries from the starting position $g_1$ of the scan are magnified by the same factor M. Thus, if B indicates the enlarged image of the specified area A, its forward edge $b_1$ is at a magnified distance lM from the starting position $p_1$ of the scan on the copy paper P and its backward edge $b_2$, likewise, is at another magnified distance l'M from the starting position $p_1$ of the scan. If the dimension of the paper P in the direction of the scan is also L and if L is smaller than l'M, the image B sticks out of the copy paper position and the protruding portion of the image becomes lost. With a trimming copying machine of a conventional type, therefore, a larger copy sheet is sometimes required to be used.

SUMMARY OF THE INVENTION

It is therefore an object of the present invention to provide a trimming copying machine with which the loss of image of the type described above can be prevented.

The above and other objects of the present invention are achieved by providing an improved trimming copying machine which, being of the conventional type as far as it feeds a copy paper corresponding to the scanning of an original document in one direction, comprises end distance setting means for setting the distance between the starting position of the scan and the backward edge of the specified area, calculating means for obtaining a difference by subtracting the length of the copy paper in the direction of the scan from the product of the aforementioned distance and specified magnification, and paper feed delay means for delaying the timing for starting to feed to copy paper by a time period which corresponds to the aforementioned difference, if this difference is positive.

With a trimming copying machine thus comprised according to the present invention, the aforementioned product represents the distance between the starting position $p_1$ of the scan of the copy paper and the backward edge $b_2$ of the image B and the aforementioned difference, if it is positive, indicates the distance by which the image protrudes from the copy paper position, that is, the length of the portion of the image which is lost. In other words, there is no loss of image if this difference is zero or negative because the image does not stick out of the paper position in this situation. If the difference is positive, therefore, the aforementioned delay means serve to delay the feeding of the copy paper according to the distance by which the image sticks out of the paper position. This delay in timing is equivalent to moving the end position of the scan backwards to the backward edge of the image so as to prevent the loss of image.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
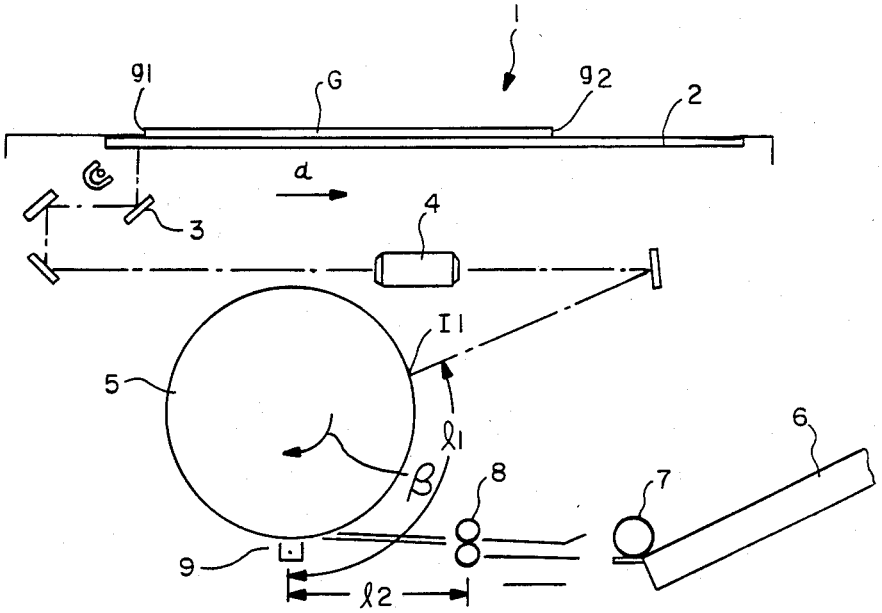
FIG. 1 is a schematic drawing showing the structure of a trimming copying machine embodying the present invention.
Figure 5:
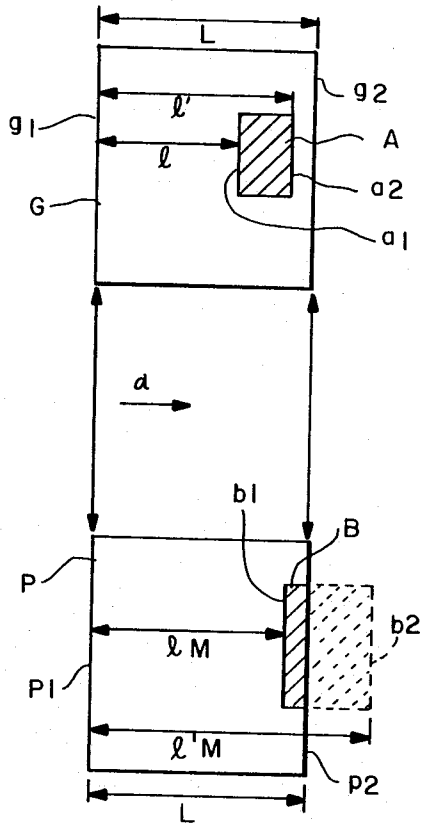
FIG. -5 (PRIOR ART)
FIG. 5 is a drawing for showing how a loss of image may occur with a conventional trimming copying machine.

In FIG. 1 wherein symbols defined above in connection with FIG. 5 indicate equivalent or similar parts and values, numeral 1 generally indicates a trimming copying machine embodying the present invention. A portion of the original document G placed on the glass plate 2 is optically taken out by means of a mirror 3, etc. and is made incident into a zoom lens 4 which forms a slit-like image on the surface of a photosensitive body 5. The mirror 3, etc. move in the direction of the arrow $\alpha$ to scan the entire surface of the document G and the photosensitive body 5 correspondingly rotates in the direction of the arrow $\beta$ such that the image of the entire document G is formed on the photosensitive body 5. Magnification of the image is determined by the magnification by the zoom lens 4 and also by the ratio between the scanning speed of the mirror 3, etc. and the speed of rotation of the photosensitive body 5.

The image formed on the photosensitive body 5 is an electrostatic latent image which is made visible as a toner image by a developing device (not shown). When trimming is effected, static charge is erased by means of a charge erasing device (not shown) everywhere except for a predetermined specified area such that the image becomes visible as a toner image only in such a specified area.

Copy paper is taken out of a paper cassette 6 by the operation of a feeder roller 7. After it is made to wait by stopping rollers 8 so that its motion will be synchronized with the rotation of the photosensitive body 5, it is moved at the same speed as the speed of rotation of the photosensitive body 5. In other words, if $l_1$ is the distance between the image forming point $I_1$ on the photosensitive body 5 corresponding to the starting position $g_1$ of the scan and the image transfer section 9 and if $l_2$ is the distance between the stopping rollers 8 and the image transfer section 9, the paper waits at the stopping rollers 8 until the photosensitive body 5 rotates by $l_1-l_2$ before it is advanced to the photosensitive body 5. This is how the position on the photosensitive body 5 corresponding to this starting point $g_1$ of the scan is made to coincide with the forward edge of the paper. The toner image on the photosensitive body 5 is transferred onto the paper at the transfer section 9. The transferred image is fixed thereafter and this completes the process of copying.

Figure 2:
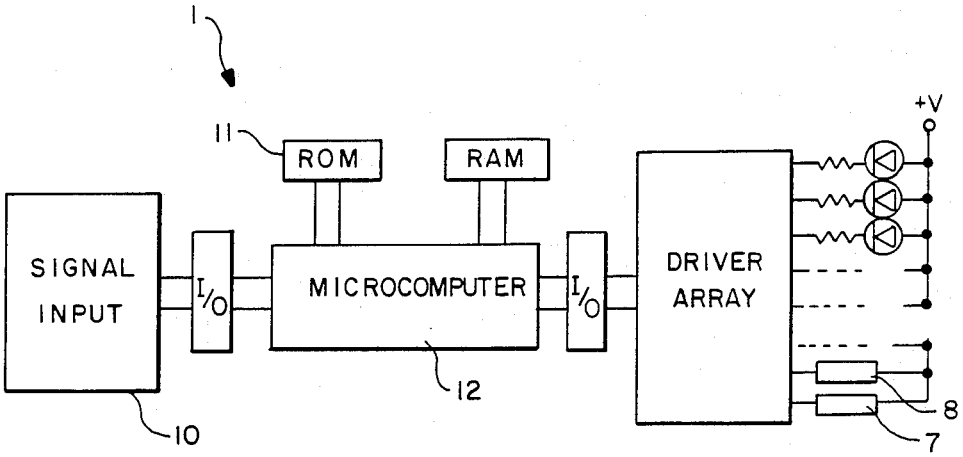
FIG. 2 is a block diagram of the control system of the trimming copying machine of FIG. 1.

In FIG. 2 which is a block diagram of the control system of the trimming copying machine 1, numeral 12 indicates a microcomputer which controls the motion of the mirrors 3, etc., the setting and motion of the zoom lens 4, the rotation of the photosensitive body 5, the driving of the rollers 7 and 8, etc. on the basis of the user's commands from a signal input device 10 as well as a program stored in ROM 11.

Figure 3:
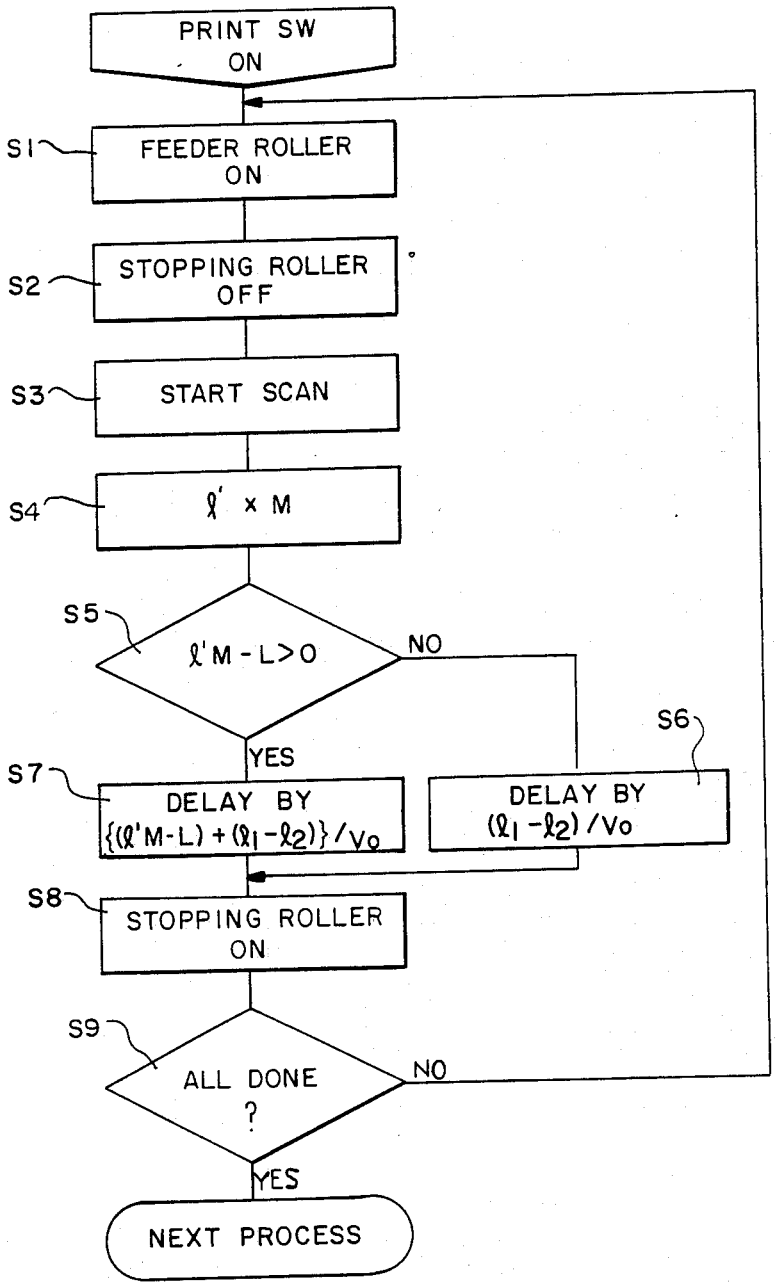
FIG. 3 is a flow chart for the operation of the trimming copying machine of FIG. 1.
Figure 4:
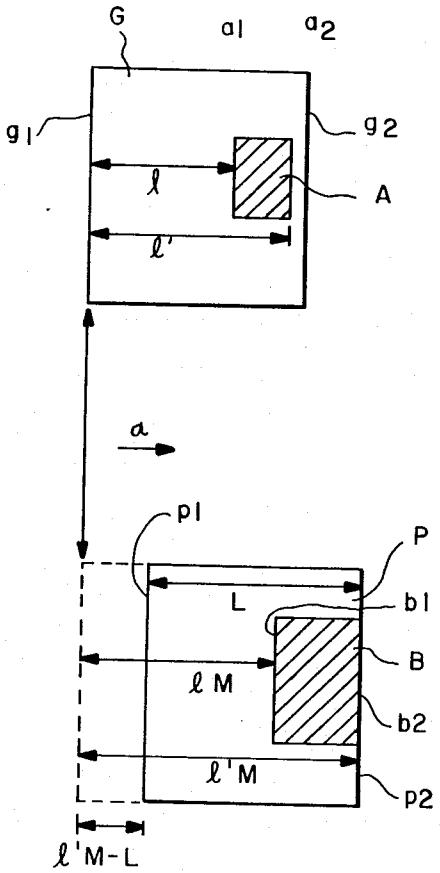
FIG. 4 is a drawing for explaining the trimming and enlargement operations by the trimming copying machine of FIG. 1.

Next, the operation which characterizes the present invention for preventing the loss of image at the time of trimming is explained by way of FIGS. 3 and 4. Firstly, the operator enters through the signal input device 10 the distance l from the starting position $g_1$ of the scan of the document G to the forward edge $a_1$ of the specified area A. Secondly, the distance l' from the starting position $g_1$ of the scan of the document G to the backward edge $a_2$ of the specified area A is similarly entered. Next, magnification M is set and the size of the copy paper P is selected. For the sake of simplicity of explanation, it will be assumed hereinafter that the paper P is of the same size as the document G.

When a print switch is pressed thereafter, the microcomputer 12 switches on the feeder roller 7 and a sheet of copy paper is taken out of the paper cassette 6 (S1). When the paper reaches the position of the stopping rollers 8, it is made to wait (S2) and the mirror 3, etc. are moved in the direction of the arrow $\alpha$ to start a scan (S3). The motion of the zoom lens 4 and the rotation of the photosensitive body 5 are also started simultaneously. Next, the distance l' and the magnification M are multiplied together (S4) and the distance L of the copy paper P in the direction of the scan is subtracted from the product l'M and it is checked whether the difference thus calculated is positive or negative (S5). If the product l'M is not greater than L, the backward edge $b_2$ of the enlarged image B would be on the left-hand side of the backward edge $p_2$ of the paper P. Thus, the paper is held at the stopping rollers 8 for a time period given by $(l_1-l_2)/V_0$ where $V_0$ represents the speed by which the paper is transported to the photosensitive body 5 (S6 to S8). This situation is no different from the operation by a conventional trimming copying machine.

If the product l'M is greater than L, a loss of image would result if the paper were fed in the conventional manner because a portion of the image B near its backward edge $b_2$ sticks out of the paper position. The distance by which protrusion occurs is l'M−L. Thus, the paper P is made to wait at the stopping rollers 8 for a longer period of time given by $\{(l'M-L)+(l_1-l_2)\}/V_0$ before it is advanced to the photosensitive body 5 (S7 to S8). With this waiting period, the backward edge $b_2$ of the image coincides with the backward edge $p_2$ of the paper P and hence there is no loss of image. This operation is repeated until the specified number of copies have been made (S9).

The foregoing description of a preferred embodiment of the invention has been presented for purposes of illustration and description. It is not intended to be exhaustive or to limit the invention to the precise form disclosed, and many modifications and variations are possible in light of the above teaching. Such modifications and variations that may be apparent to a person skilled in the art are intended to be included within the scope of the invention.

What is claimed is:

1. In a trimming copying machine for producing a copy from a document by scanning said document and feeding a copy paper sheet in correspondence therewith, said machine being capable of copying only a specified area of said document, the improvement wherein said trimming copying machine comprises input means for setting a first distance indicative of a first position on a document along a predetermined scan direction where a scan of a specified area of said document along said scan direction is to be started, a second distance indicative of a second position on said document along said scan direction where said scan is to end, a length L indicative of the size of a copy paper sheet along said scan direction and a magnification M, calculating means for determining a value L' indicative of the length of said specified area of said document along said scan direction and calculating a difference L'M−L' and adjusting means for adjusting the starting time for feeding said copy paper if said difference is positive such that an image of said specified area of said document is formed entirely within the area of said copy sheet.

2. The trimming copying machine of claim 1 wherein said adjusting means is so programmed that the rear edge of said image coincides with the rear edge of said copy paper sheet.

3. The trimming copying machine of claim 1 wherein said adjusting means serves to delay said starting time by $((L'M-L)/V_0)-t_0$ where $V_0$ is the speed at which said copy paper sheet is moved when said image is transferred onto said copy paper sheet and $t_0$ is the delay caused by said adjusting means when said difference is negative.

* * * * *